US010252437B2

(12) United States Patent
Adami

(10) Patent No.: US 10,252,437 B2
(45) Date of Patent: Apr. 9, 2019

(54) LINE FOR PROCESSING A CONTINUOUS WEB MATERIAL AND RELATED METHOD

(71) Applicant: FOSBER S.P.A., Monsagrati-Pescaglia (IT)

(72) Inventor: Mauro Adami, Viareggio (IT)

(73) Assignee: FOSBER S.P.A., Monsagrati-Pescaglia (IT)

( * ) Notice: Subject to any disclaimer, the term of this patent is extended or adjusted under 35 U.S.C. 154(b) by 180 days.

(21) Appl. No.: 14/049,392

(22) Filed: Oct. 9, 2013

(65) Prior Publication Data

US 2014/0102274 A1 Apr. 17, 2014

(30) Foreign Application Priority Data

Oct. 11, 2012 (IT) ..... FI2012A0206

(51) Int. Cl.

| | |
|---|---|
| ***B26D 7/18*** | (2006.01) |
| ***B26D 1/01*** | (2006.01) |
| ***B65H 35/08*** | (2006.01) |
| *B26D 7/00* | (2006.01) |

(52) U.S. Cl.

CPC ..... *B26D 7/18* (2013.01); *B26D 1/015* (2013.01); *B26D 7/1818* (2013.01); *B65H 35/08* (2013.01); *B26D 2007/0018* (2013.01); *B65H 2601/511* (2013.01); *B65H 2701/1762* (2013.01); *Y10T 83/04* (2015.04); *Y10T 83/0448* (2015.04); *Y10T 83/222* (2015.04)

(58) Field of Classification Search

CPC ..... B26D 7/18; B26D 7/015; B26D 1/015; B26D 7/0675; Y10T 83/0476; Y10T 83/222; B65H 2701/1762

USPC ..... 83/23, 90–96; 198/307.1, 309, 340, 198/346.2, 347.1, 347.3, 353, 363–364, 198/431

See application file for complete search history.

(56) References Cited

U.S. PATENT DOCUMENTS 3,830,121 A * 8/1974 Makeev ..... B21D 43/287 83/104
3,866,498 A * 2/1975 Jarman ..... B65H 29/26 83/104

(Continued)

FOREIGN PATENT DOCUMENTS

DE 102008033775 A1 1/2010
EP 0733448 A1 9/1996

*Primary Examiner* — Ghassem Alie
*Assistant Examiner* — Nhat Chieu Do
(74) *Attorney, Agent, or Firm* — McGlew and Tuttle, P.C.

(57) ABSTRACT

The line comprises a feed path (P) of the web material (N) and, along the feed path, a transverse cutter (5) for cutting scraps (FS) from the continuous web material (N). The line includes a system for removing scraps of web material cut by the cutter. The system for removing scraps is fitted with a scrap accumulator member (21). The accumulator member (21) is movable in a direction generally parallel to the feed path (P) of the web material between: a position for receiving scraps, wherein the distance between the accumulator member (21) and the cutter (5) is such that scraps (FS) generated by the cutter (5) are collected by the accumulator member (21); and a standby position, at a distance from the cutter (5) such that scraps (FS) generated by the cutter are collected in a space (D) between the cutter (5) and the accumulator member (21).

20 Claims, 6 Drawing Sheets

(56) References Cited

U.S. PATENT DOCUMENTS

| | | | | | |
|---|---|---|---|---|---|
| 3,935,769 | A * | 2/1976 | Obenshain | B65H 29/51 | 270/60 |
| 4,319,762 | A * | 3/1982 | Streit | B65F 1/122 | 210/464 |
| 4,474,094 | A * | 10/1984 | Hanni | B21D 43/287 | 83/104 |
| 5,732,609 | A * | 3/1998 | Marschke | B26D 7/18 | 198/369.2 |
| 6,279,721 | B1 * | 8/2001 | Lyngso | B64F 1/366 | 198/369.2 |
| 6,561,338 | B2 * | 5/2003 | Ito | B65G 37/02 | 198/341.05 |
| 7,018,155 | B1 * | 3/2006 | Heberling | B62B 3/0606 | 414/408 |
| 2002/0189416 | A1 * | 12/2002 | Gross | B26D 7/015 | 83/418 |
| 2004/0177737 | A1 | 9/2004 | Adami | | |
| 2008/0038102 | A1 * | 2/2008 | Murphy | B65F 1/1468 | 414/403 |
| 2009/0155033 | A1 * | 6/2009 | Olsen | B62B 3/08 | 414/462 |
| 2010/0012265 | A1 | 1/2010 | Hartl et al. | | |
| 2012/0288354 | A1 * | 11/2012 | Moore | B65H 31/10 | 414/790.1 |

* cited by examiner 33
29
27
35
25
f25
5
35
31
27
29
35A
35A
23
23
21
f21
23
23

LINE FOR PROCESSING A CONTINUOUS WEB MATERIAL AND RELATED METHOD

TECHNICAL FIELD

The present invention relates to lines for converting or processing continuous web materials, in particular so-called "dry ends" in plants for corrugated cardboard processing.

STATE OF THE ART

For the production of corrugated cardboard, processing lines are used that receive a continuous strip of corrugated cardboard coming from a so-called "wet end", i.e. a wet section of the production line, and transform the continuous corrugated cardboard into strips and then into sheets cut to measure and scored according to the specifications of the various processing orders.

A processing line for a continuous strip of corrugated cardboard for the production of single sheets is described, for example, in US 2004/0177737. This publication also describes a cutter for making transverse cuts in the order change zones and possibly for the formation of scraps to be eliminated from the continuous flow of material through the line.

Downstream of the transverse cutters there is generally a system for collecting the scrap sheets that are formed for example in the transition zone from one order to the next order, or generally in zones of the continuous web material where production defects are found.

An example of a system for collecting scrap sheets in a corrugated cardboard processing line is described in EP 0733448. Another example of a cutter with a relative scrap diverter system is described in DE 102008033775.

Normally the number of sheets scrapped in each transitional phase in which the cutter operates is limited. These scrap sheets are collected in an accumulator member, for example a basket or similar, which is then recovered so that the scrap material can be recycled.

In some cases, it happens that the capacity of the accumulator member is insufficient to collect all the scraps produced during a transitional processing phase, during which the cutter produces scrap sheets. When this happens, it is necessary to stop the line, remove the accumulator member, for example a basket, and restart the processing line. This results in loss of production and increased scraps.

There is therefore a need for a more efficient scrap collection system downstream of a transverse cutter in a processing line for corrugated cardboard or other substantially continuous web materials.

SUMMARY OF THE INVENTION

According to one aspect, the invention provides a system that resolves wholly or in part at least some of the problems of known converting or processing lines, particularly when it comes to the accumulation of scraps.

Substantially, according to one aspect, there is provided a converting or processing line for a web material fed in a substantially continuous manner, for example corrugated cardboard, said line comprising a feed path of the web material and, along the feed path, a transverse cutter for cutting scraps from the continuous web material. Furthermore, the line comprises a system for removing scraps of web material cut by the cutter. The system for removing scraps is fitted with a scrap accumulator member. The accumulator member is movable in a direction generally parallel to the feed path of the web material between: a position for receiving scraps, wherein the distance between the accumulator member and the cutter is such that scraps generated by the cutter are collected by the accumulator member; and a standby position, at a distance from said cutter such that scraps generated by the cutter are collected in a space between the cutter and the accumulator member.

If the collection system container is filled before the transitional phase of the cutter work is completed, then moving the container frees space next to the cutter, where further scrap sheets can be unloaded and collected, without any need to stop the processing line.

According to another aspect, a method is envisaged for collecting scraps generated by a cutter in a processing line of a continuous web material, comprising the steps of:

- feeding the continuous web material along a feed path;
- arranging a scrap accumulator member in a position for receiving scraps generated by the cutter;
- cutting, by means of the cutter, a plurality of scraps of web material;
- accumulating the scraps on an accumulator member arranged in proximity of the cutter;
- moving the accumulator member with the scraps accumulated thereon away in a direction generally parallel to the feed path;
- continuing to accumulate scraps formed by the cutter in a space between the cutter and the accumulator member.

Further features and embodiments of the invention are described hereunder and are further indicated in the appended claims, which form an integral part of the present description. The brief description provided above identifies characteristics of the various embodiments of the present invention so that the following detailed description can be better understood and so that the contributions to the art may be better appreciated. Naturally, there are other characteristics of the invention which will be described below and will be set forth in the appended claims. It must be understood that the various embodiments of the invention are not limited in their application to the structural details and to the arrangements of components described in the following description or illustrated in the drawings. The invention can be implemented in other embodiments and put into practice in various ways. Moreover, it must be understood that the phraseology and terminology employed herein are purely for descriptive purposes and must not be considered limiting.

Therefore, those skilled in the art will understand that the concept on which the description is based can be used as a basis to design other structures, other methods and/or other systems to implement the various objects of the present invention. Consequently, it is important that the claims are considered as inclusive of those equivalent structures which do not depart from the spirit and from the scope of the present invention.

BRIEF DESCRIPTION OF THE DRAWINGS

The invention will be better understood by following the description and accompanying drawings, which show practical embodiments of the invention. More in particular, in the drawings.

DETAILED DESCRIPTION OF AN EMBODIMENT

The detailed description below of exemplary embodiments refers to the accompanying drawings. The same reference numbers in different drawings identify identical or similar elements. Moreover, the drawings are not necessarily to scale. The detailed description below does not limit the invention. Rather, the scope of the invention is defined by the appended claims.

Reference in the description to "an embodiment" or "the embodiment" or "some embodiments" means that a particular characteristic, structure or element described in relation to an embodiment is included in at least one embodiment of the object described. Therefore, the phrase "in an embodiment" or "in the embodiment" or "in some embodiments" used in the description does not necessarily refer to the same embodiment or embodiments. Moreover, the particular characteristics, structures or elements can be combined in any suitable manner in one or more embodiments.

Figure 1:
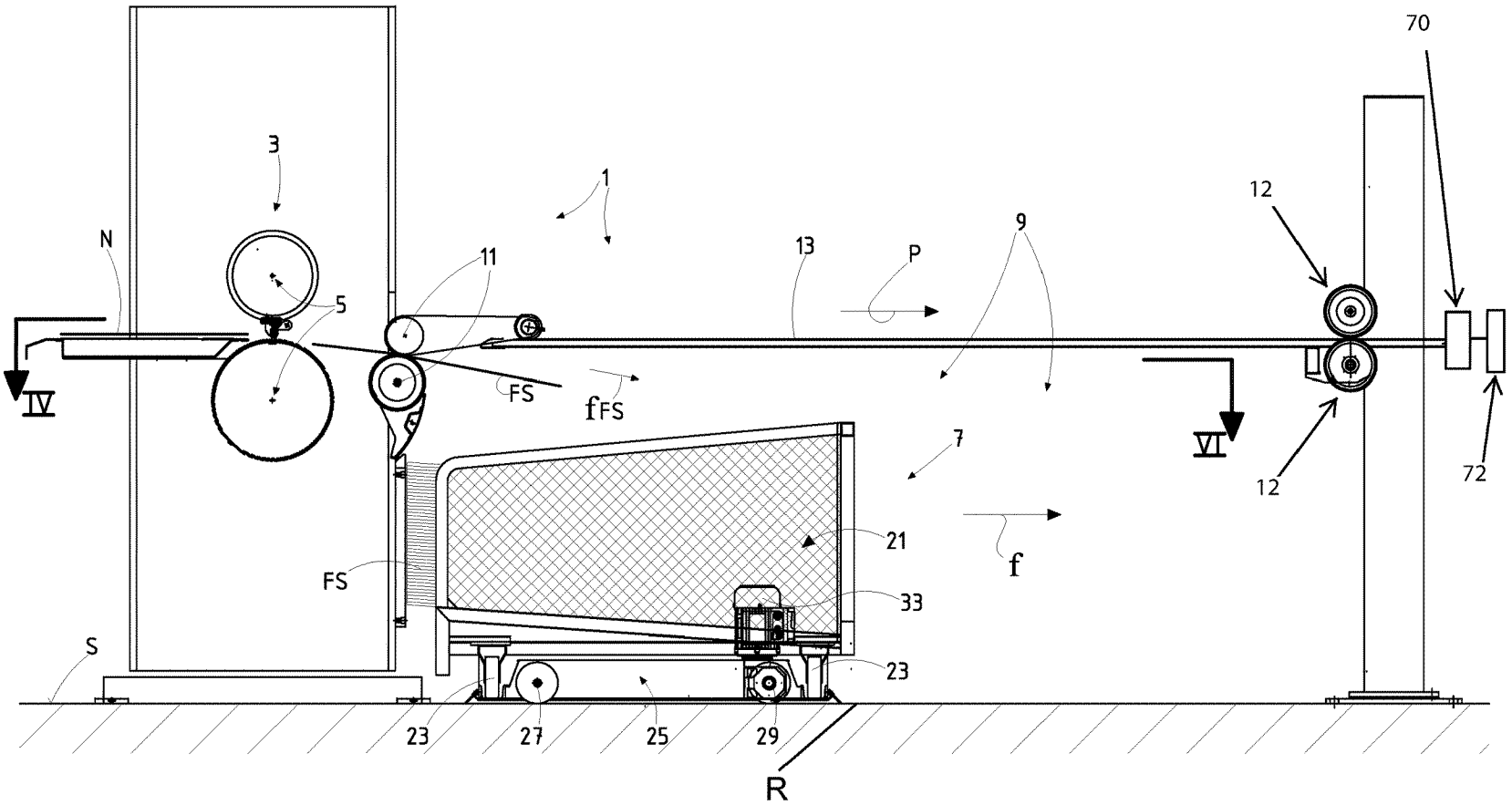
FIG. 1 shows a schematic side view of a cutter and the relative system for removing scraps in a first operating position.

With initial reference to FIG. 1, the illustrated schematic side view shows a portion of a corrugated cardboard processing line, here indicated by the number 1. The processing line comprises a station 3 wherein a transverse cutter 5 is arranged, which, when required, for example during an order change, executes a transverse cut of the web material N advancing along the feed path P. In some cases, the cutter 5 can be used to cut scrap sheets from the continuous web material N. When the cutter 5 is in operation, as shown in FIG. 1, the scrapped sheets are diverted towards an accumulator member, here indicated by the number 7 and positioned in a collection zone 9 adjacent to the station 3 where the cutter 5 is positioned. A pair of rollers 11 are controlled to divert the path of the web material N towards the collection zone 9 when the cutter 5 is in operation to form scrap sheets. During normal line operation, the transverse cutter 5 is de-activated and the web material N is made to advance along a sliding plane 13 according to the path P towards longitudinal slitting and scoring systems 70 and/or towards transverse cutting systems 72 via rollers 12 to form sheets of cut web 5 material. These systems are already known and will not be described in detail.

The accumulator member 7 may comprise a container 21, for example in the form of a trolley basket, i.e. fitted with wheels, preferably partly pivoting. In the embodiment shown, the container 21 comprises four wheels 23. At least two of these wheels may be pivoting to facilitate moving the container.

The container 21 is positioned on a slide 25, suitably fitted with wheels 27, 29. The wheels 27, 29 may be engaged on rails R fixed to the floor, which extend under the feed path P. In other embodiments, as shown in the drawing, the wheels 27, 29 rest directly on the walking surface or floor S of the plant where the processing line 1 is installed. This simplified the construction of the plant, since it is no longer necessary to place rails on the 15 ground, and the need for building works is eliminated.

In advantageous embodiments the wheels 29 may be keyed onto a drive shaft 31, rotated by a motor 33 on board the slide 25.

Figure 3:
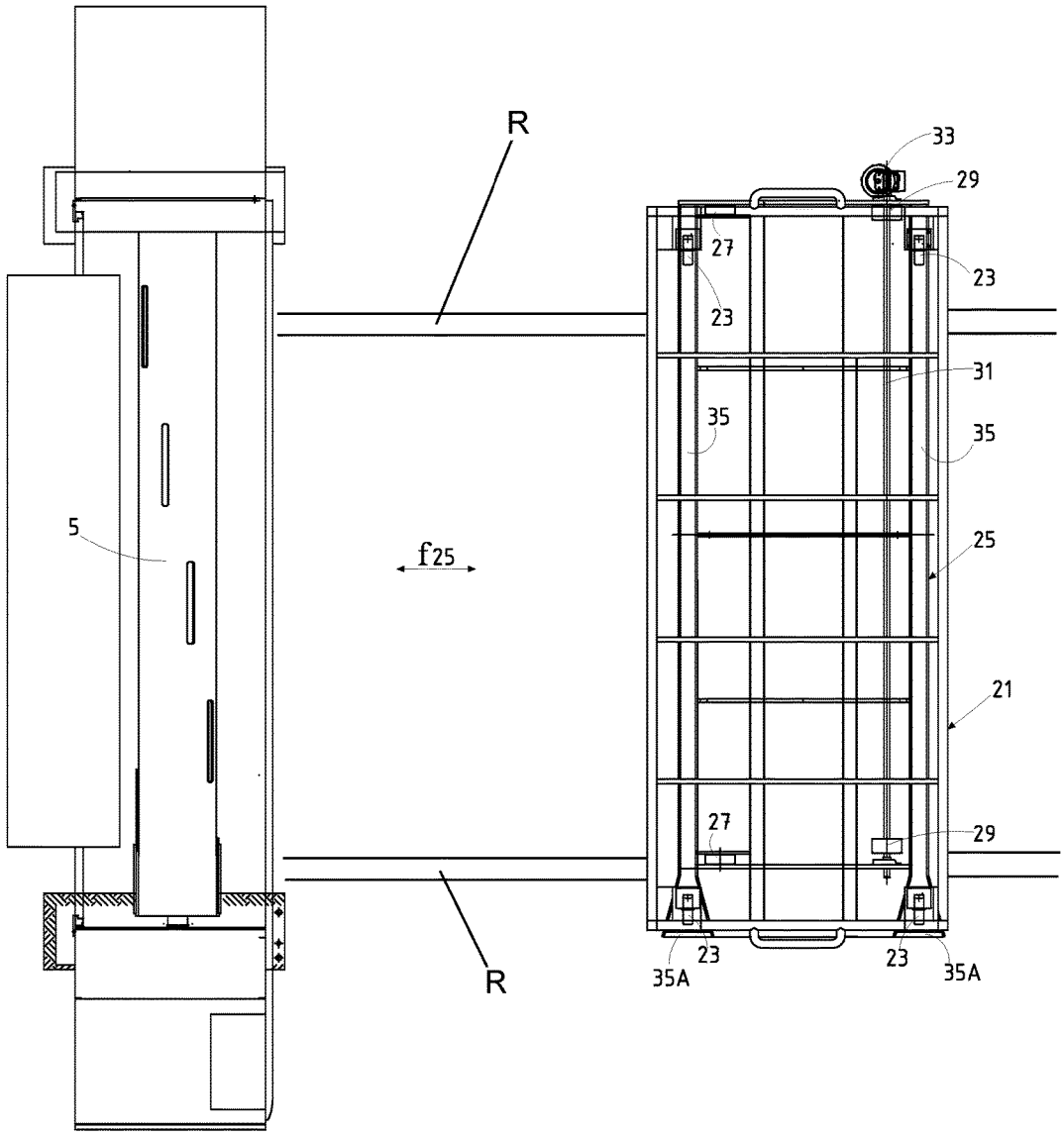
FIG. 3 shows a plan view according to III-III in FIG. 2, from which the scrap sheets have been removed for greater clarity of the drawing.
Figure 4:
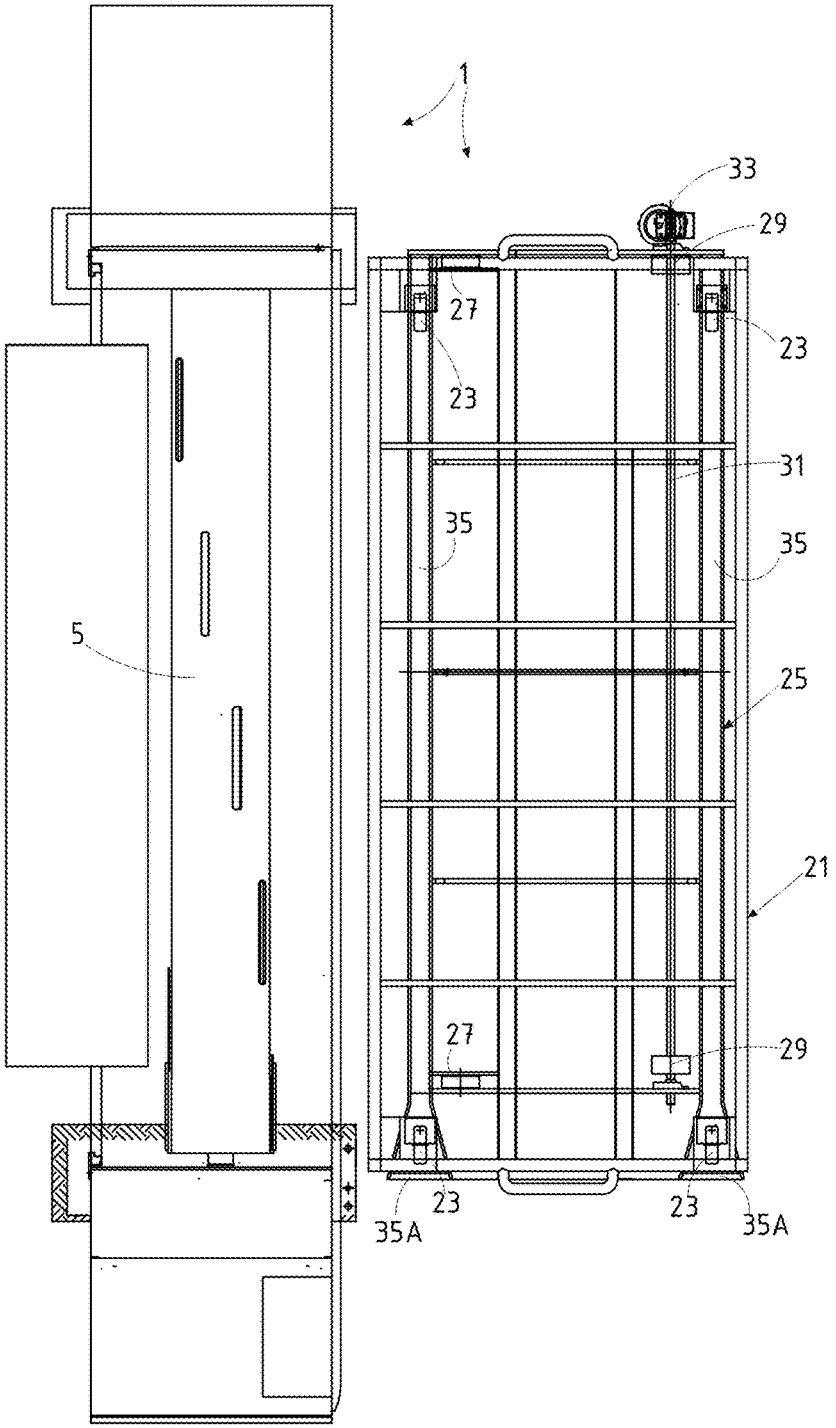
FIG. 4 shows a view according to IV-IV in FIG. 1.
Figure 5:
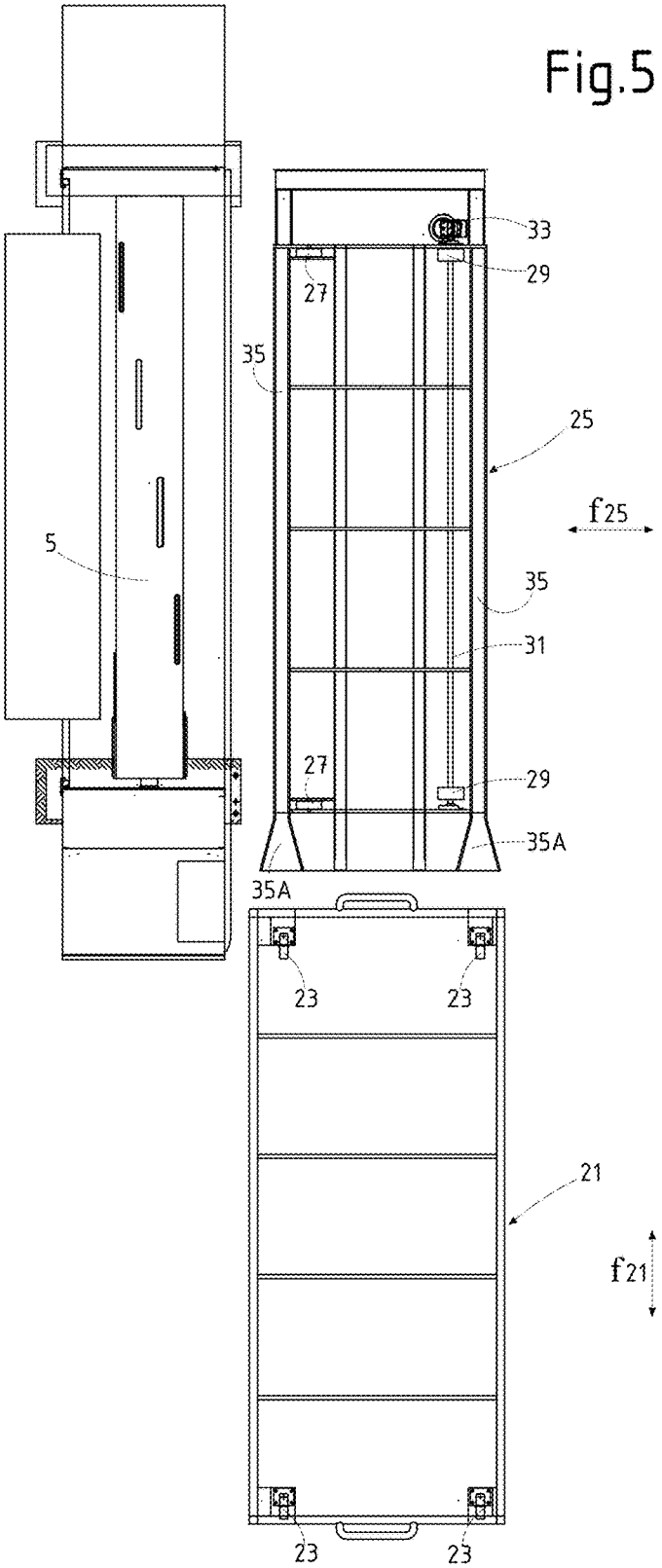
FIG. 5 shows a plan view similar to the view shown in FIG. 4 with the accumulation container removed from the collection zone.

As can be seen in particular in the plan views shown in FIGS. 3, 4 and 5, in this embodiment the slide 25 may comprise guides 35 oriented at right angles to a direction of movement of the slide 25 (represented by the double arrow f25). The direction of movement according to f25 is generally parallel to the feeding direction of movement of the web material N along the path P. The term 'generally parallel' indicates that the two movements are substantially parallel in a plan view. In this way, the slide 25 as it moves remains under the feed path P of the web material N. The path may be inclined, for example to raise or lower the web material, while maintaining the feeding direction according to the longitudinal extension of the web material N.

The guides 35 may have an entry zone 35A shaped to facilitate insertion of the wheels 23 of the container 21, which (as can be seen by comparing FIGS. 4 and 5) can be mounted above the slide 25 or removed therefrom. Indeed, the container 21 can be moved in the direction of the double arrow f21 with respect to the slide 25 to be positioned on the slide 25, or it can be removed therefrom and transported, for example, to a scrap recovery zone for recycling.

Figure 2:
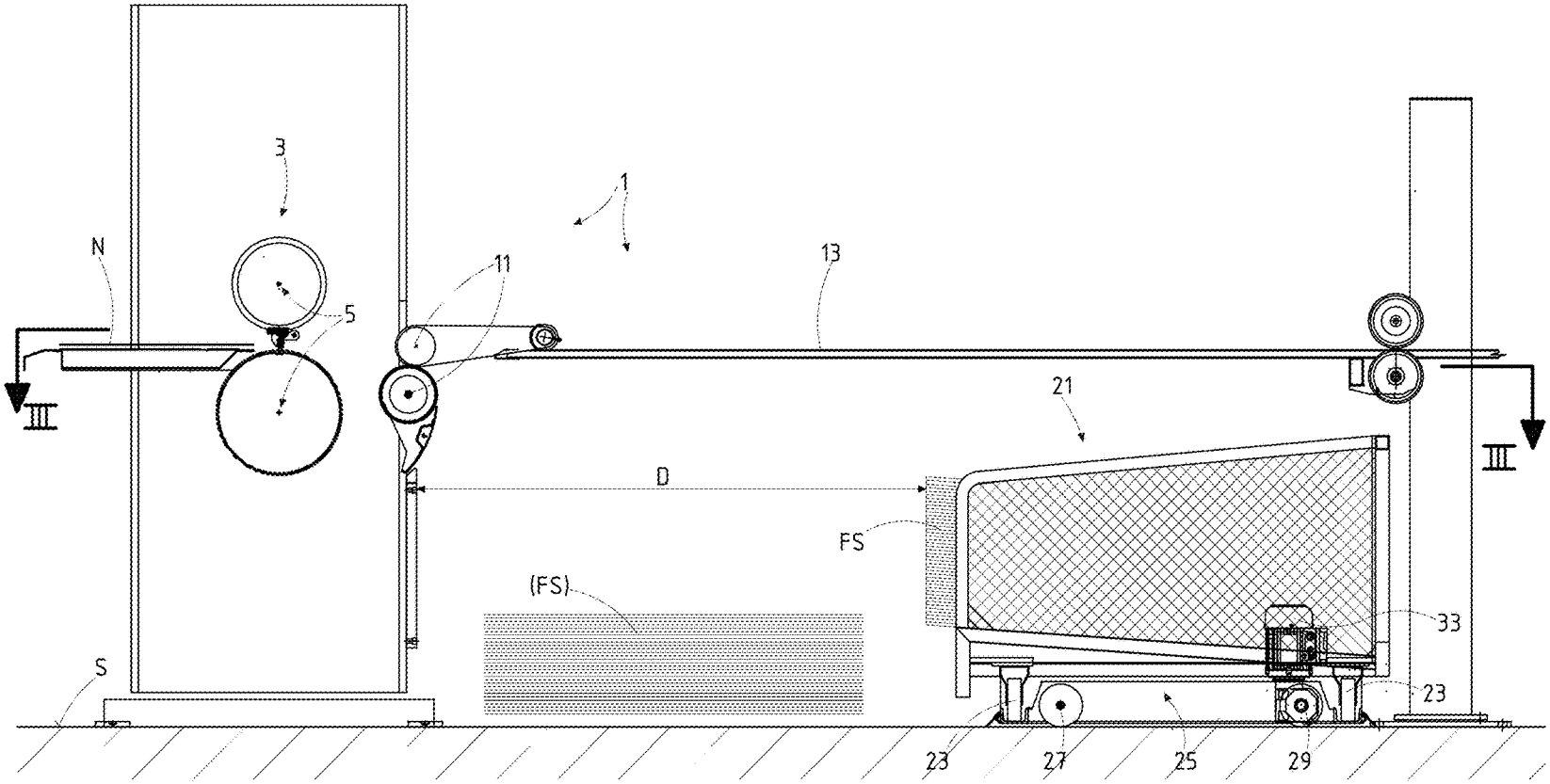
FIG. 2 shows a view similar to that shown in FIG. 1 in a second operating position.

As can be seen by comparing FIGS. 1 and 2 and FIGS. 3 and 4, the accumulator member comprising the container 21 may take at least two alternative positions, respectively adjacent to the cutter 5 (FIGS. 1 and 4) or distanced therefrom in the direction of the path P (FIGS. 2 and 3).

The operation of the processing line and the scrap accumulator member described above is as follows.

FIG. 1 shows a phase of accumulation of scrap sheets FS, coming from the cutter 5, inside the container or basket 21 positioned under the processing line 1, and in particular under the path P, adjacent to the cutter 5. The scrap sheets FS cut by the cutter 5 are expelled by the pair of rollers 11 in the direction of the arrow fFS into the container or basket 21 forming a stack of scrap sheets FS.

If the number of scrap sheets FS produced by the cutter in this transitional phase is lower than the maximum capacity of the container 21, at the end of the transitional phase the cutter 5 will be placed off-line and the web material N will begin to be fed along the path P towards the stations downstream of the cutter along the processing line 1. The container 21 can be removed by moving it in a transverse direction (arrow f21, FIG. 5) to move it away from the processing line 1 and bring it together with the scrap sheets FS contained therein to a recovery and recycling zone. The transverse movement may be manual.

Vice-versa, if the number of scrap sheets FS produced in a transitional phase by the cutter 5 is higher than the capacity of the container 21, then to avoid having to stop the line 1 and remove the container 21 replacing it with an empty one, the slide 25 with the container 21 carried above it is transferred (with a movement in the direction of the arrow f in FIG. 1) from the scrap receiving position shown in FIG. 1, which is downstream of the cutter 5, to the standby position 25 shown in FIG. 2, which is downstream of the scrap receiving position with respect to an advancing direction along the feed path P. The feed path P extends above the accumulator member 7 In the position shown in FIG. 2 the container 21 is distanced from the scrap sheets FS unloading zone by a distance D such as to allow the accumulation of a second stack of scrap sheets, indicated by (FS) in FIG. 2, under the rollers 11 and in front of the container 21.

The total quantity of scrap sheets that can be accumulated on the container 21 and in the space left free by the container 21 when it is translated to the position shown in FIG. 2 is equal to or greater than the maximum number of scrap sheets FS that are produced during any processing transitional phase during which the cutter 5 produces scrap sheets. Therefore, the transitional phase can be completed without having to stop the line and remove the scrap sheets FS from collection zone.

Once the transitional phase is completed, the operator can access the collection zone and arrange to: remove the scrap sheets (FS) accumulated between the cutter 5 and the container 21; move the slide 25 using the motor 33 from the position shown in FIG. 2 back to the position shown in FIG. 1; and then remove the container 21 from the slide 25 by rolling the wheels 23 of the container 21 along the guides 35 of the slide 25, thereby bringing the container 21 to the position shown in FIG. 5.

The embodiment described is particularly efficient because on the one hand it does not require the execution of civil works for installation of the scrap sheets accumulation system. Indeed, the slide 25 runs on its own wheels directly on the floor S of the plant. The slide 25 can be made very low with the guides 35 arranged flush with the floor so as to facilitate the loading and unloading of the container or basket 21 onto and from the slide 25.

The possibility is not excluded of having movement of the container 21 in the direction of the arrow f from the position shown in FIG. 1 to the position shown in FIG. 2 using a system different than the motorized slide 25.

For example, a conveyor belt may be used that runs in a direction generally parallel to the path P of the web material N along the processing line 1. The container 21 of the accumulator member may be positioned on the conveyor belt. This type of solution is illustrated schematically in FIG. 6, where the same numbers indicate parts which are identical or equivalent to those of the embodiment illustrated in FIGS. 1 to 5.

Figure 6:
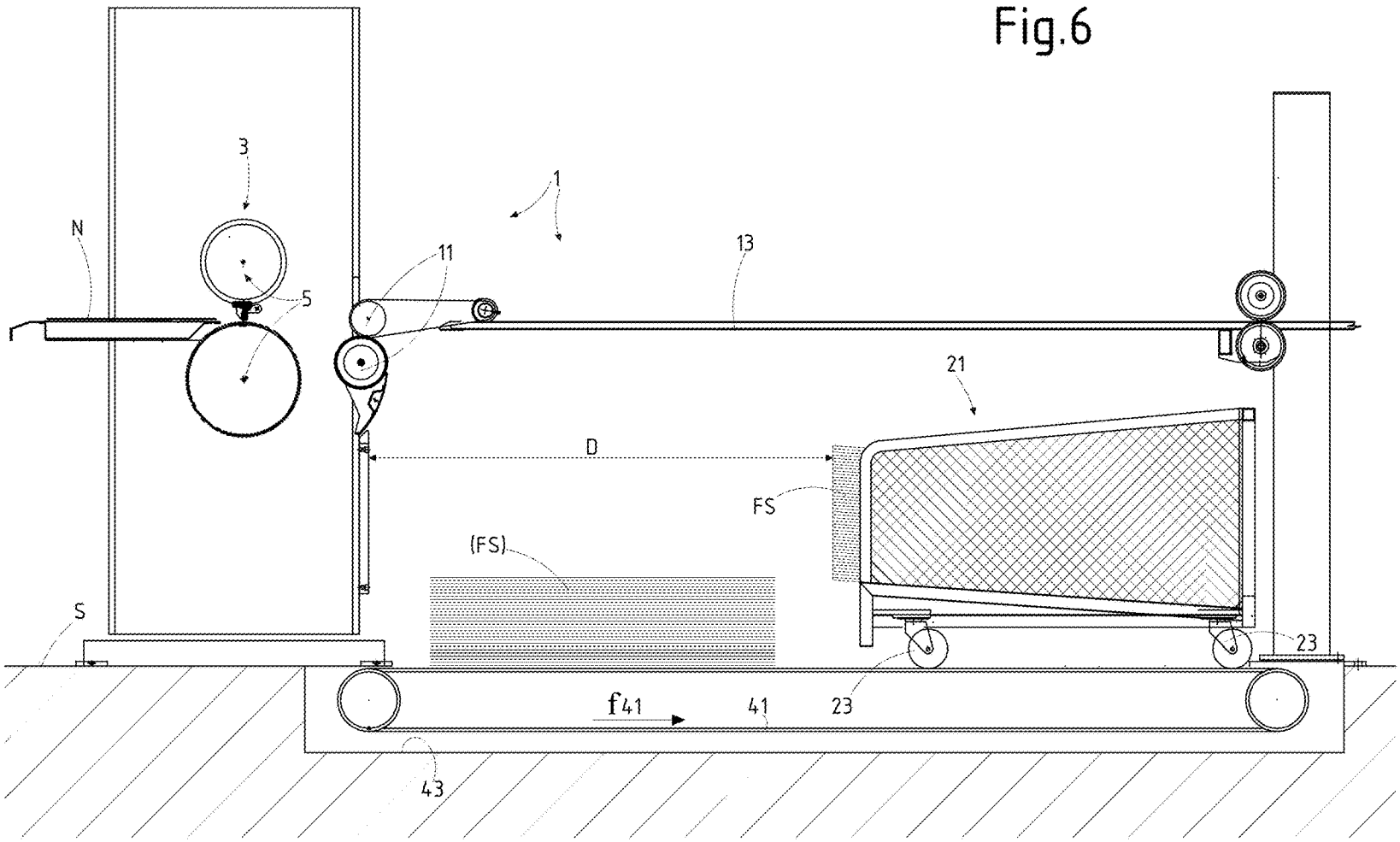
FIG. 6 shows a view similar to the view shown in FIG. 1 of a modified embodiment.

In the embodiment shown in FIG. 6, the container 21 rests with its wheels 23 on the conveyor belt 41, which may move in the direction shown by the arrow f41 in a direction substantially and generally parallel to the feeding direction of the web material N along the path P. The surface of the conveyor belt 41 may be fitted with members suitable to hold the container or basket 21 steady on the upper surface of the conveyor belt 41. For example the conveyor belt may be fitted with transverse ribs forming guide and restraining channels for the wheels 23 of the container 21.

This second embodiment is less advantageous than the previous embodiment, since it requires the installation of the conveyor belt 41 in a trench 43 built specifically under the level of the floor S. Nevertheless, in some cases this solution may be advantageous from the point of view of the quantity of scrap sheets FS that can be accumulated in each transitional phase of cutter operation.

Indeed, the conveyor belt 41 may be of a length greater than that shown in FIG. 6 and configured so as to move the container 21 up to a distance that is a multiple of the distance D, so as to form more than one stack of scrap sheets (FS) directly on the conveyor belt 41. These stacks of scrap sheets are then carried one after the other to the zone immediately adjacent to the cutter 5, where the operator can remove the scrap sheets through a single controlled opening of a protective guard placed around the processing line 1.

This embodiment may also have the advantage of allowing the accumulation of scrap sheets FS of a longitudinal size (i.e. in the direction of the path P) greater than the normal size for which the container 21 is designed.

The embodiments described above and illustrated in the drawings have been discussed in detail as examples of embodiment of the invention. Those skilled in the art will understand that many modifications, variants, additions and omissions are possible, without departing from the principles, concepts and teachings of the present invention as defined in the appended claims. Therefore, the scope of the invention must be determined purely on the basis of the broadest interpretation of the appended claims, comprising these modifications, variants, additions and omissions therein. The term "comprise" and derivatives thereof do not exclude the presence of further elements or steps besides those specifically indicated in a given claim. The term "a" or "an" preceding an element, means or characteristic of a claim does not exclude the presence of a plurality of these elements, means or characteristics. When a device claim lists a plurality of "means", some or all of these "means" can be implemented by a single component, member or structure. The stating of given elements, characteristics or means in distinct dependent claims does not exclude the possibility of said elements, characteristics or means being combined with one another. When a method claim lists a sequence of steps, the sequence in which these steps are listed is not binding, and can be modified, if the particular sequence is not indicated as binding. Any reference numbers in the appended claims are provided to facilitate reading of the claims with reference to the description and to the drawing, and do not limit the scope of protection represented by the claims.

What is claimed is:

1. A line for processing a continuous web material comprising:

a straight feed path adapted to advance a continuous web material therealong;

along said feed path, a stationary cutting station comprising a transverse cutter for cutting scraps from said continuous web material;

a system for removing scraps of web material cut by said cutter, said removing system comprising a scrap accumulator member and said feed path extending stationarily above and beyond said system for removing scraps and said feed path being adapted to feed said continuous web material beyond said system for removing scraps, wherein said accumulator member is movable under the feed path in a direction oriented, with respect to the feed path of the web material such as to move between a position for receiving scraps, wherein a distance between the accumulator member and the cutter is such that scraps generated by the cutter are collected by the accumulator member, and a standby position, distanced from said cutter such that scraps generated by the cutter are collected in a scrap collection space between the cutter and the accumulator member, wherein the position for receiving scraps and the standby position are located under the feed path, one after another in a feed direction of the web material along the feed path, the position for receiving scraps being arranged downstream of the cutter and upstream of the standby position with respect to the direction of the web material along the feed path, wherein the accumulator member moves with respect to the scrap collection space when moving from the position for receiving scraps to the standby position and when moving from the standby position to the position for receiving scraps such that the accumulator member is positioned in the scrap collection space when in the position for receiving scraps, the accumulator member being carried on a slide movable under the feed path in a direction of the feed path, the accumulator member having accumulator member wheels, the accumulator member wheels engaging the slide, the slide comprising guides oriented at right angles to a direction of movement of the slide, the accumulator member wheels engaging the guides, the accumulator member and the slide being configured to load the accumulator member on the slide and unload the accumulator member from the slide with a movement transverse to the feed path, said standby position being distanced from the cutter in a direction of the feed path, the slide being provided with at least one motor-driven wheel to be moved parallel to the feed path.

2. The processing line as claimed in claim 1, further comprising:

one of a slitter scorer and a transverse cutting system arranged along the feed path downstream of the system for removing scraps, wherein said accumulator member is provided with a movement of displacement in a direction transverse to the feed path.

3. The processing line as claimed in claim 1, wherein the movable slide is provided with wheels running on a flooring surface, at least one of the scraps engaging the floor surface when the accumulator member is in the standby position, the direction of movement of the slide always being parallel to the feed path, wherein a direction of movement of the slide is parallel to the feed path.

4. The processing line as claimed in claim 3, wherein at least another wheel of the slide is motorized.

5. The processing line as claimed in claim 4, wherein the slide moves parallel to the feed path along a path located exclusively below the feed path.

6. The processing line as claimed in claim 1, wherein at least another wheel of the slide is motorized.

7. The processing line as claimed in claim 1, wherein the slide moves parallel to the feed path along a slide movement path, the slide movement path always being located below the feed path.

8. The processing line as claimed in claim 7, wherein the accumulator member wheels are oriented in a direction transverse to the feed path when the slide moves from the standby position to the position for receiving scraps.

9. The processing line as claimed in claim 8, wherein some of said accumulator member wheels are pivoting.

10. The processing line as claimed in claim 1, wherein the accumulator member comprises an accumulation container.

11. The processing line as claimed in claim 10, wherein the accumulator member moves in a transverse direction with respect to the feed path via the accumulator member wheels.

12. The processing line as claimed in claim 11, wherein some of said accumulator member wheels are pivoting.

13. The processing line as claimed in claim 1, wherein each of said scrap accumulator wheels is fixed in said slide when said slide moves between said standby position and said position for receiving scraps, wherein said scrap accumulator wheels do not rotate when said slide moves between said standby position and said position for receiving scraps, each of said scrap accumulator wheels being perpendicular to said at least one motor-driven wheel when said scrap accumulator wheels are fixed to said slide, wherein said scrap accumulator wheels face in a direction transverse to said feed path when said scrap accumulator wheels are fixed to said slide.

14. A line for processing a continuous web material comprising:

a feed path advancing a continuously extending web material therealong;

along said feed path, a stationary cutting station comprising a transverse cutter for cutting said continuous web material into scraps;

a plurality of rollers located along said feed path, one of said rollers being located at a spaced location from another one of said rollers, wherein said another one of said rollers is located downstream of said one of said rollers with respect to a feed direction of said continuously extending web material, said plurality ofrollers being located downstream of said transverse cutter with respect to said feed direction of said continuously extending web material;

a system for removing scraps of web material cut by said cutter, said removing system comprising rails and a scrap accumulator member, said feed path extending above and beyond said system for removing scraps, wherein said accumulator member is movably connected to said rails such that the accumulator member moves under the feed path between a position for receiving scraps, wherein a distance between said accumulator member and the cutter is such that scraps generated by the cutter are collected by the accumulator member, and a standby position, distanced from said cutter such that scraps generated by said cutter are collected in a scrap collection space between the cutter and the accumulator member when the accumulator member is in said standby position, said position for receiving scraps and said standby position being located between said one of said rollers and said another one of said rollers, said space being located downstream of the cutter with respect to said feed direction of said web material along said feed path, said standby position being located downstream of said position for receiving scraps with respect to said feed direction of said web material along said feed path, said position for receiving scraps being located downstream of said cutter with respect to said feed direction of said web material along said feed path, wherein said scrap accumulator member moves with respect to said scrap collection space when moving from said position for receiving scraps to said standby position and when moving from said standby position to said position for receiving scraps such that said scrap accumulator member is positioned in said scrap collection space when in said position for receiving scraps, said scrap accumulator member being carried on a slide movable under said feed path in a direction substantially parallel to said feed path, said scrap accumulator member and said slide being configured to load said scrap accumulator member on said slide and unload said scrap accumulator member from said slide with a movement transverse to said feed path, said scrap accumulator member comprising scrap accumulator member wheels, said slide having guides arranged perpendicular to said direction substantially parallel to said feed path, said scrap accumulator member wheels engaging said guides when said scrap accumulator member is arranged on said slide, said standby position being distanced from said cutter in a direction of said feed path, said slide being provided with at least one motor-driven wheel to be moved parallel to said feed path.

15. The processing line as claimed in claim 14, further comprising:

one of a slitter scorer and a transverse cutting system arranged along said feed path downstream of said system for removing scraps, wherein said rails extend parallel to said feed path, said slide being movable along a floor surface, at least one of said scraps of web material engaging said floor surface when said scrap accumulator member is in said standby position, said scrap accumulator member being connected to said slide and said slide being mounted to said rails, wherein a portion of said continuously extending web is located upstream of said transverse cutter and another portion of said continuously extending web is located downstream of said transverse cutter with respect to said feed direction of said web material along said feed path.

16. The processing line as claimed in claim 15, wherein the position for receiving scraps and the standby position are located under the feed path, one after another in the feed direction of the web material along the feed path.

17. A line for processing a continuous web material comprising:

a straight feed path for advancing a continuous web material therealong;

along said feed path, a stationary cutting station comprising a transverse cutter cutting said continuous web material into scraps;

a first roller located downstream of said transverse cutter with respect to a feed direction of said continuous web material;

a second roller located downstream of said first roller and said transverse cutter with respect to said feed direction of said continuous web material, wherein said second roller is located at a spaced location from said first roller, said first roller and said second roller defining a portion of said feed path;

a system for removing scraps of web material cut by said cutter, said removing system comprising a slide and a scrap accumulator member, said scrap accumulator member comprising scrap accumulator member wheels, said feed path extending above and beyond said system for removing said scraps, said scrap accumulator being mounted to said slide, said slide being mounted for movement such that said scrap accumulator and said slide move under said feed path between a scrap receiving position and a standby position, said slide comprising guides extending in a direction perpendicular to a direction of movement of said slide, said scrap accumulator member wheels engaging said guides when said scrap accumulator is mounted to said slide, whereby said scrap receiving position and said standby position are located under said feed path, said scrap receiving position and said standby position being located between said first roller and said second roller, said scrap receiving position being located at a spaced location from said standby position, wherein said scraps generated by the cutter are collected by the accumulator member with said slide and said accumulator member in said scrap receiving position, said accumulator member and said scrap receiving position being located completely downstream of said transverse cutter with respect to said feed direction of said continuous web material along said feed path, wherein scraps generated by said cutter are collected in a scrap collection space between said first roller and said accumulator member with said slide and said accumulator member in said standby position, said space being located downstream of said transverse cutter with respect to said feed direction of said web material along said feed path, said standby position being located downstream of said scrap receiving position with respect to said feed direction of said web material along said feed path, wherein said scrap accumulator member moves with respect to said scrap collection space when moving from said scrap receiving position to said standby position and when moving from said standby position to said scrap receiving position such that said scrap accumulator member is positioned in said scrap collection space when in said scrap receiving position, said scrap accumulator member being carried on a slide movable under said feed path in a direction substantially parallel to said feed path, said scrap accumulator member and said slide being configured to load said scrap accumulator member on said slide and unload said accumulator member from said slide with a movement transverse to said feed path, said standby position being located at a spaced location from said cutter in a direction of the feed path, said slide being provided with at least one motor-driven wheel to be moved parallel to said feed path.

18. The processing line as claimed in claim 17, further comprising:

one of a slitter scorer and a transverse cutting system arranged along said feed path downstream of said system for removing scraps, wherein the scrap receiving position and the standby position are located under the feed path, one after another in said feed direction of the web material along the feed path, said slide and said accumulator member moving relative to a floor surface in a direction parallel to said feed path between said standby position and said scrap receiving position, wherein a portion of said continuously extending web is located upstream of said transverse cutter and another portion of said continuously extending web is located downstream of said transverse cutter with respect to said feed direction of said web material along said feed path, at least one of said scraps engaging said floor surface when said scrap accumulator member is in said standby position, said slide moving in a back and forth direction under said feed path, said back and forth direction being parallel to said feed path.

19. The processing line as claimed in claim 17, wherein each of said scrap accumulator wheels is fixed in said slide when said slide moves between said standby position and said scrap receiving position, wherein said scrap accumulator wheels do not rotate when said slide moves between said standby position and said scrap receiving position, each of said scrap accumulator wheels being perpendicular to said at least one motor-driven wheel when said scrap accumulator wheels are fixed to said slide, wherein said scrap accumulator wheels face in a direction transverse to said feed path when said scrap accumulator wheels are fixed to said slide.

20. The processing line as claimed in claim 14, wherein each of said scrap accumulator wheels is fixed in said slide when said slide moves between said standby position and said position for receiving scraps, wherein said scrap accumulator wheels do not rotate when said slide moves between said standby position and said position for receiving scraps, each of said scrap accumulator wheels being perpendicular to said at least one motor-driven wheel when said scrap accumulator wheels are fixed to said slide, wherein said scrap accumulator wheels face in a direction transverse to said feed path when said scrap accumulator wheels are fixed to said slide.

* * * * *